US011667459B2

(12) United States Patent
Gonzales

(10) Patent No.: US 11,667,459 B2
(45) Date of Patent: Jun. 6, 2023

(54) INFANT FORMULA RECEPTACLE WITH PLIABLE POUCH, AND INFANT FEEDING SYSTEMS

(71) Applicant: Sonia Gonzales, Bridgeport, WV (US)

(72) Inventor: Sonia Gonzales, Bridgeport, WV (US)

( * ) Notice: Subject to any disclaimer, the term of this patent is extended or adjusted under 35 U.S.C. 154(b) by 320 days.

(21) Appl. No.: 16/899,613

(22) Filed: Jun. 12, 2020

(65) Prior Publication Data

US 2021/0387787 A1 Dec. 16, 2021

(51) Int. Cl.

| | |
|---|---|
| ***B65D 81/32*** | (2006.01) |
| ***A61J 9/00*** | (2006.01) |
| ***B65D 75/00*** | (2006.01) |
| ***A61J 11/00*** | (2006.01) |
| ***B65D 75/58*** | (2006.01) |
| ***A61J 11/04*** | (2006.01) |

(52) U.S. Cl.

CPC ..... *B65D 81/3266* (2013.01); *A61J 9/00* (2013.01); *A61J 9/001* (2013.01); *A61J 11/002* (2013.01); *A61J 11/008* (2013.01); *A61J 11/04* (2013.01); *B65D 75/008* (2013.01); *B65D 75/5883* (2013.01)

(58) Field of Classification Search

CPC ... A61J 9/00; A61J 9/001; A61J 11/002; A61J 11/008; A61J 11/04; B65D 75/008; B65D 75/5583; B65D 81/3266

See application file for complete search history.

(56) References Cited

U.S. PATENT DOCUMENTS

| | | | | |
|---|---|---|---|---|
| 2,885,104 A | | 5/1959 | Greenspan et al. | |
| 3,190,288 A | * | 6/1965 | Butler | A61J 11/02 215/11.5 |
| 3,294,227 A | | 7/1973 | Chin et al. | |
| 3,744,625 A | | 7/1973 | Chin | |
| 3,983,994 A | | 10/1976 | Wyslotsky | |
| 4,339,046 A | * | 7/1982 | Coen | A61J 9/04 215/11.4 |
| 4,629,080 A | | 12/1986 | Carveth | |
| 4,984,697 A | * | 1/1991 | Kelly | A61J 9/0646 215/11.1 |
| 5,131,760 A | * | 7/1992 | Farmer | B65D 75/30 222/107 |
| 5,423,421 A | | 6/1995 | Inoue et al. | |

(Continued)

*Primary Examiner* — Tri M Mai

(74) *Attorney, Agent, or Firm* — Dinsmore & Shohl LLP; Monika L. Jaensson

(57) ABSTRACT

A disposable receptacle useful with an infant feeding system, including a pliable pouch. The pliable pouch may have a single compartment, or a pair of compartments wherein a first compartment is filled with powdered formula, and a second compartment is filled with distilled water. When compartmentalized, the compartments are separated by a burst seal designed to fail upon subjection to pressure of between about 1-3 lbs. The receptacles include a cylindrical fitment with a one-way valve removably positioned therewithin. A top seal of the pliable pouch is secured about the body of the fitment. The receptacles may be used with an infant feeding system having a support disc with an aperture to receive and secure the fitment, and a nipple having an internal chamber sized and configured to tightly and removably receive a portion of the fitment. The infant feeding system may optionally include a bottle and a securing ring.

10 Claims, 7 Drawing Sheets

(56) References Cited

U.S. PATENT DOCUMENTS 5,429,254 A * 7/1995 Christine ..... A61J 9/001 215/11.1
5,611,776 A 3/1997 Simmons et al.
5,910,138 A * 6/1999 Sperko ..... C08L 53/025 604/416
6,032,810 A * 3/2000 Meyers ..... A61J 11/045 215/11.1
6,142,344 A * 11/2000 Kai ..... B65D 75/5883 222/105
6,945,394 B2 9/2005 Segovia, Jr. et al.
7,055,683 B2 6/2006 Bourque et al.
7,506,754 B2 3/2009 Segovia, Jr. et al.
D681,837 S 5/2013 Rushing et al.
8,783,519 B2 * 7/2014 Fontaine ..... B65D 51/249 222/173
8,820,549 B1 9/2014 Estrada
8,915,359 B2 12/2014 DiLiberto et al.
9,902,528 B2 2/2018 Jaouen
2002/0066678 A1 6/2002 Sharon et al.
2003/0094464 A1 * 5/2003 Decottignies ..... B65D 75/5883 222/105
2004/0118710 A1 6/2004 Bourque et al.
2006/0011497 A1 1/2006 Segovia et al.
2006/0093765 A1 5/2006 Mueller
2006/0144875 A1 * 7/2006 Etesse ..... B05B 11/047 222/494
2006/0188614 A1 8/2006 Shapira
2006/0202901 A1 * 9/2006 Noro ..... H01Q 1/42 343/789
2007/0114144 A1 5/2007 Suzuki et al.
2007/0144923 A1 6/2007 Houwaert et al.
2008/0276645 A1 11/2008 Murray
2008/0312751 A1 * 12/2008 Pugsley ..... A61F 13/0253 623/23.72
2009/0071926 A1 * 3/2009 Berkovitch ..... A61J 9/04 215/11.4
2009/0238495 A1 9/2009 Anderson
2010/0176151 A1 * 7/2010 Johnson ..... B65D 77/067 222/542
2010/0314347 A1 * 12/2010 Haberman ..... A61J 11/002 215/11.4
2011/0151069 A1 * 6/2011 Harding ..... B65D 85/72 215/11.1
2012/0037587 A1 * 2/2012 Tirosh ..... A61J 9/04 220/366.1
2012/0074002 A1 3/2012 Steele et al.
2012/0255972 A1 * 10/2012 Schneider ..... B65D 1/323 222/570
2013/0188888 A1 7/2013 Liu et al.
2013/0304016 A1 * 11/2013 Kouno ..... B65D 81/3266 604/410
2014/0107608 A1 * 4/2014 McBean ..... A61M 1/062 215/11.1
2015/0014369 A1 * 1/2015 Hatton ..... F16K 21/04 29/890.12
2015/0043838 A1 2/2015 Jaouen
2015/0217906 A1 * 8/2015 Ichikawa ..... B65D 35/38 222/92

* cited by examiner

INFANT FORMULA RECEPTACLE WITH PLIABLE POUCH, AND INFANT FEEDING SYSTEMS

BACKGROUND

The disclosed technology regards a disposable infant formula or breast milk receptacle useful with an infant feeding system or as a component of an assemblable baby bottle.

Various attempts have been made to create a disposable ready-to-use nursing container i.e., a nursing container which the consumer receives with the nursing formula therein.

At present, commercial disposable nursing systems most frequently include a flexible liner which is inserted into a rigid plastic holder. The liner includes an open end which must be wrapped about one end of the rigid holder. A separate container of infant formula must be purchased and opened, and the contents placed in the flexible liner along with distilled or purified water. The operator must then stretch a pre-sterilized nipple over the flexible liner and the top of the holder. The operator must have also performed the nipple sterilization procedure. After the nipple is secured to the holder, a securing ring is typically placed about the nipple to hold it more securely to the holder.

This known prior art has several disadvantages. The operator must go to great lengths to ensure cleanliness, especially where the nursing formula is for a very young infant. Contamination is possible during the transfer of the formula into the liner. Spillage is common, especially during the step of mounting the nipple on the holder, and once the infant is suckling on the nipple there is possibly of air ingestion, which in turn can lead to discomfort and pain.

While these difficulties are not insurmountable, they do require much time and care to avoid. The whole operation is made even more difficult when away from the home or hospital. Furthermore, the procedure must be performed frequently, given the feeding schedule of infants.

The present invention solves these problems presented by the prior art by providing a portable, disposable, more convenient receptacle and feeding system. In an embodiment of the disclosed technology, a pliable pouch already has the nursing formula and distilled/purified water stored therein, in separate compartments divided by a burst seal. The formula and water can be combined once the seal between the compartments has been burst (by applying 1-3 pounds of pressure on the part of the bag containing water, and after the seal has been burst shaking and/or massaging the bag to cause the water and powder to fully combine for consumption). In another embodiment of the disclosed technology, the pliable pouch can receive and store breast milk and/or liquid infant formula (or other liquid, e.g. apple juice). In each of these embodiments, a cap on the bag may be removed, and the bag can be squeezed to remove any air in the bag through a one-way valve. Once the nipple is mounted to the pliable pouch, a high degree of sterility is achieved. The pliable pouch as herein described can be either dropped into a shell bottle or used directly with the nipple, without the bottle or securing ring.

GENERAL DESCRIPTION

The disclosed technology regards a disposable receptacle useful with an infant feeding system, which receptacle includes a pliable pouch having a first compartment filled with powdered formula, and a second compartment filled with distilled water, the compartments being separated by a burst seal designed to fail upon subjection to pressure of between about 1-3 lbs. The receptacle further includes a cylindrical, threaded fitment, having a body, with a collar and a segmented locking ring on the exterior of the body, and a one-way valve removably positioned within the fitment. A top seal of the pliable pouch is secured about the body of the fitment.

The disclosed technology further regards an infant feeding system including a pliable pouch having a first compartment filled with powdered formula, and a second compartment filled with distilled water, the compartments being separated by a burst seal designed to fail upon subjection to pressure of between about 1-3 lbs. The pliable pouch further has a cylindrical, threaded fitment, including a body, with a collar and a segmented locking ring on the exterior of the body, and a one-way valve removably positioned within the fitment. A top seal of the pliable pouch is secured about the body of the fitment. The infant feeding system of the disclosed technology further includes a support disc having a threaded aperture to receive and secure the fitment of the pliable pouch, and a nipple having an internal chamber sized and configured to tightly and removably receive a portion of the fitment.

Optionally, the system may further include a bottle and a securing ring configured to be removably secured about a neck of the bottle. When used with a bottle, the support disc of the system has a recessed lip formed about its circumference to receive the top of the bottle neck.

The disclosed technology further regards a disposable receptacle useful with an infant feeding system, including a pliable pouch for receiving breast milk, the top of which receives and is sealed about a cylindrical, threaded fitment. The fitment includes a body, with a collar and a segmented locking ring on the exterior of the body. A one-way valve is removably positioned within the fitment. Threadably attached to the fitment is a support disc, including a cylinder protruding through the support disc, and forming an aperture to receive the fitment. Protrusions are positioned on an interior of the disc cylinder corresponding with spaces in the segmented locking ring of the fitment, to removably secure the fitment to the ring in a twist-lock manner when in use.

DESCRIPTION OF THE DRAWINGS

The above mentioned features of the invention will become more clearly understood from the following detailed description of the invention read together with the drawings in which.

DETAILED DESCRIPTION

Figure 1B:
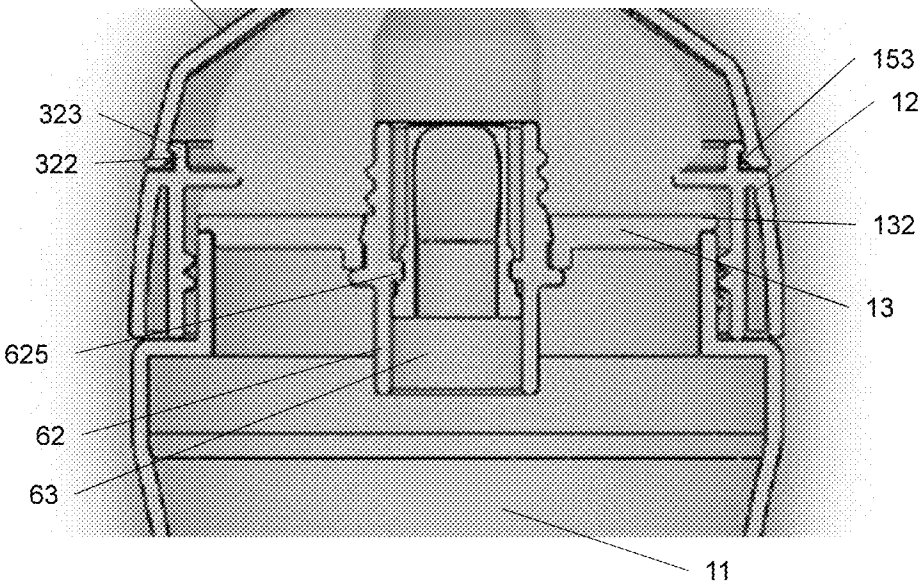
FIG. 1B is an expanded view of the interconnectedness of the components of the infant feeding system of FIG. 1A.

Referring now to the embodiments shown in the Figures, the disclosed technology is a disposable infant formula or breast milk receptacle 6 useful with or as a component of an assemblable baby bottle 1 or an infant feeding system. As hereinafter described in greater detail, the assemblable baby bottle of the disclosed technology generally includes a bottle 11, a securing ring 12, a support disc 13, a nipple 2 and a removable cap 15. In some embodiments, the receptacle is used without the assemblable baby bottle, and only with the support disc 13 and the nipple 2.

Figure 3C:
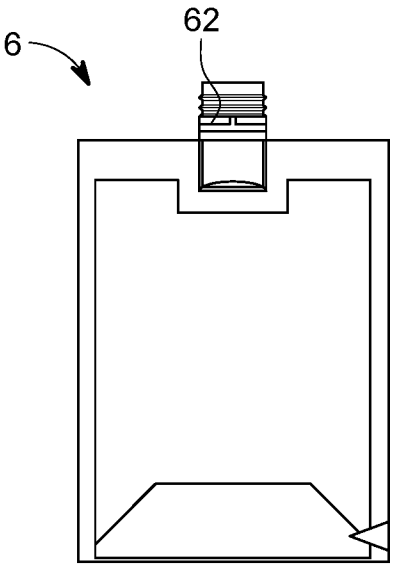
FIG. 3C is a view of another embodiment of a disposable receptacle of the disclosed technology.
Figure 3B:
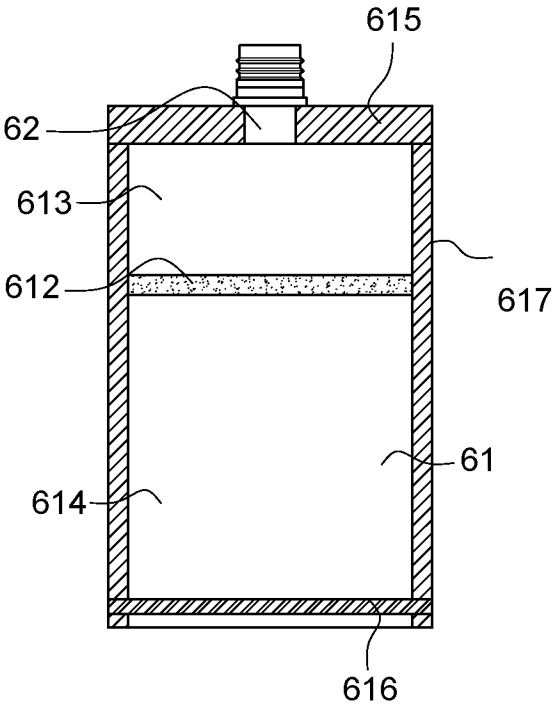
FIG. 3B is a view of another embodiment of a disposable receptacle of the disclosed technology.
Figure 3A:
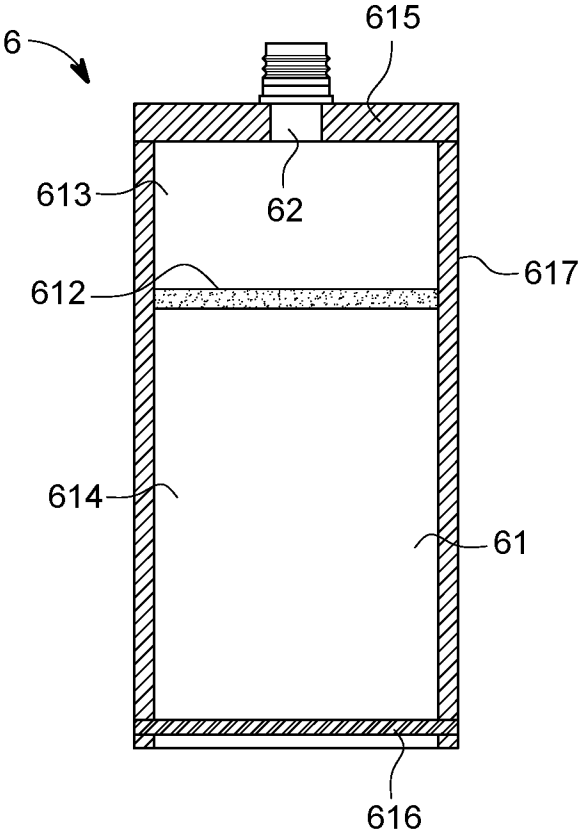
FIG. 3A is a view of an embodiment of a disposable receptacle of the disclosed technology.

As shown in FIGS. 3A, 3B and 3C, the disposable receptacle 6 of the disclosed technology generally includes a pliable pouch 61 and a cylindrical, threaded fitment 62. The pliable pouch 61 may be sized for different amounts of formula or breast milk, and is defined by a top seal 615, a closure seal 616, and side seals 617. The top seal may have a height of about ½", and the side seals may have a height of about ¼"; in the embodiments shown, the closure seal is about ¼" in height, and is positioned about ¼" above the bottom of the side seals. The bottom of the disposable receptacle may be gusseted. An aperture at the top and center of the pliable pouch is secured about the circumference of the fitment 62.

When the disposable receptacle is used to store liquid formula or breast milk, the pliable pouch may have a gusseted bottom, as shown in FIG. 3C. In this embodiment, the fitment may receive coupling means such as a funnel to couple the same with a breast pump, facilitating the delivery of breast milk from the breast pump to into the receptacle.

When the disposable receptacle is used to store powder formula, the pliable pouch may have a burst seal 612 integrated across a width thereof, to separate a first compartment 613 for powder formula from a second compartment 614 for distilled water. In the exemplary embodiment shown in FIG. 3A, the pliable pouch has a length of about 8", and a width of about 4", wherein the burst seal 612 may be about ¼" in depth and positioned about 1.875" below the top seal; this embodiment accommodates about 26.4 g powder formula and about 170.4 ml distilled water in the respective compartments 613, 614. In another exemplary embodiment as shown in FIG. 3B the pliable pouch has a length of about 6.625", and a width of about 4", wherein the burst seal may be about 1.5" below the top seal; this embodiment accommodates about 17.6 g powder formula and about 113.6 ml distilled water in the separate compartments. Other dimensions and compartment sizes would be suitable for use with the disclosed technology.

The burst seal suitable for use in the disclosed technology is intended to fail at a relatively low pressure, about 1-3 lbs., or about 2 lbs., whereas the seals forming the top, sides and closure seals are not intended to fail (although they will, at a much higher pressure). Clearly the intended pressure at failure of the burst seal should be sufficiently high so that it will not rupture in transit or otherwise prior to intended use. Eastern States Packaging, Inc., out of Stoughton, Mass., manufactures compartmentalized bags with burst seals suitable for use in the disclosed technology.

The pliable pouch may be constructed from 0.0025 clear polyster/poly film, or similar, durable, food grade material.

Figure 4B:
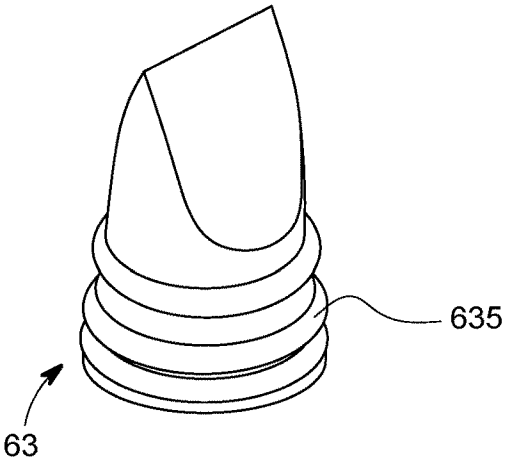
FIG. 4B is a view of a duckbill valve useful in the disclosed technology.
Figure 4A:
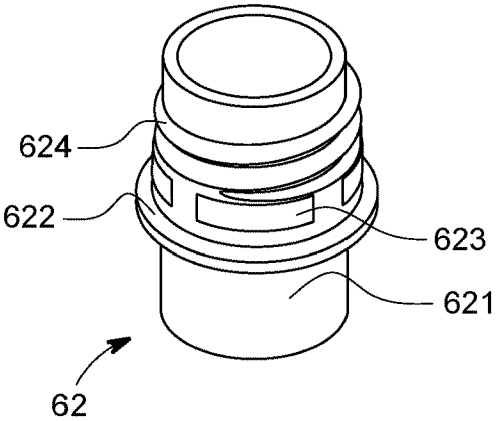
FIG. 4A is a view of an embodiment of a fitment of the disclosed technology.

As shown in FIG. 4A, the fitment 62 of the disposable receptacle includes a body 621, a collar 622, a segmented locking ring 623 and threads 624. As hereinabove discussed, the pliable pouch is secured about the circumference of the body 621, directly below the collar 622. As shown in FIG. 1B, the interior of the fitment 62 comprises an interior collar 625 protruding from the inner surface thereof, wherein the interior vacuous area of the fitment is sized to receive a one-way valve 63, such as a duckbill valve as shown in FIG. 4B. To secure the one-way valve in the interior of the fitment, the one-way valve includes a recessed ring 635 about its exterior to receive the interior collar 625 of the fitment. A cap, not shown, can be threadingly and removably engaged with the fitment to seal the receptacle as necessary.

Figure 1A:
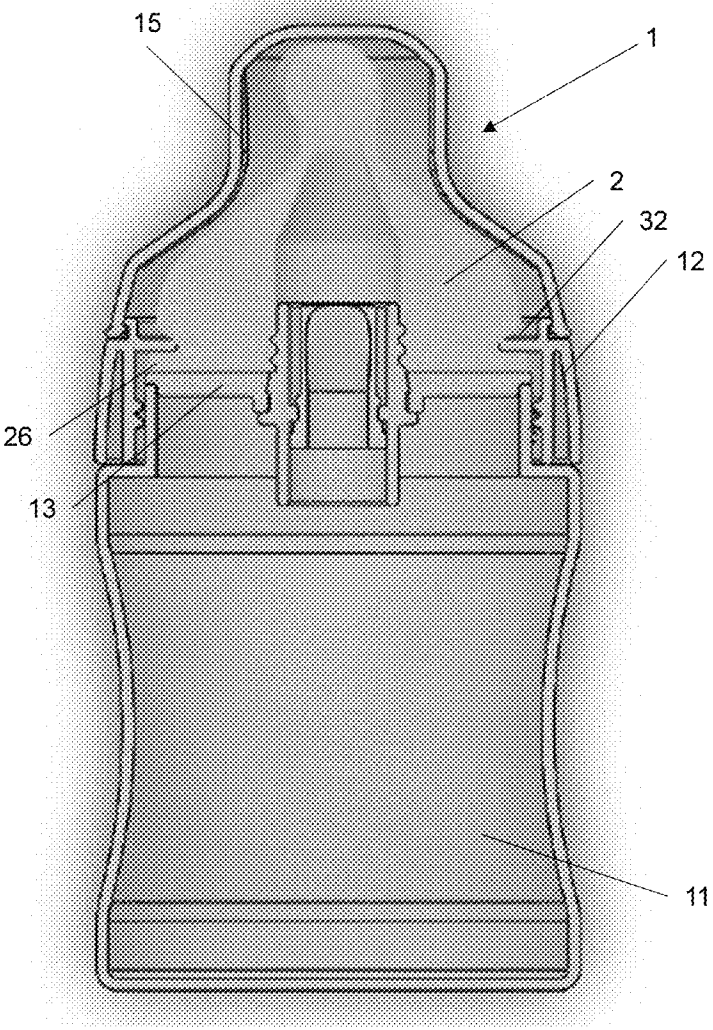
FIG. 1A is a view of an embodiment of the infant feeding system of the disclosed technology.
Figure 2:
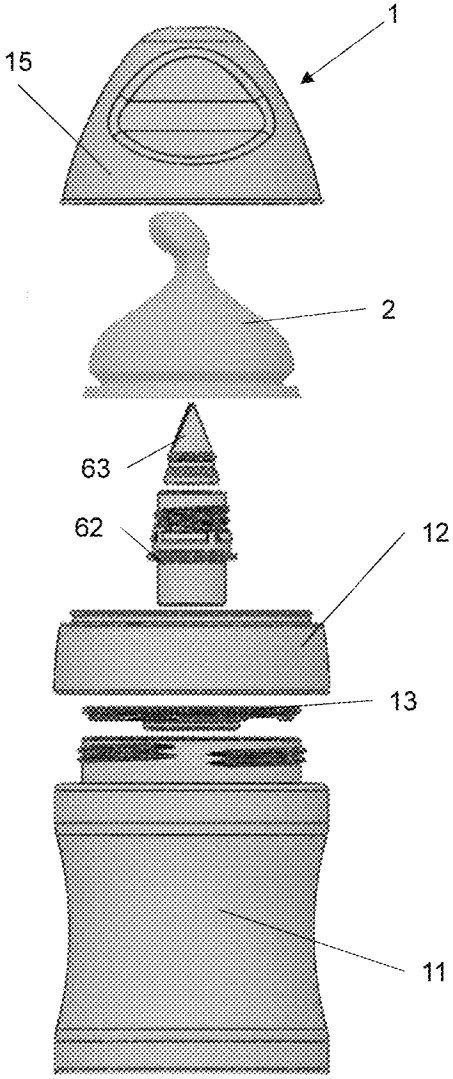
FIG. 2 is an assembly view of the components of the infant feeding system of FIG. 1A.
Figure 6:
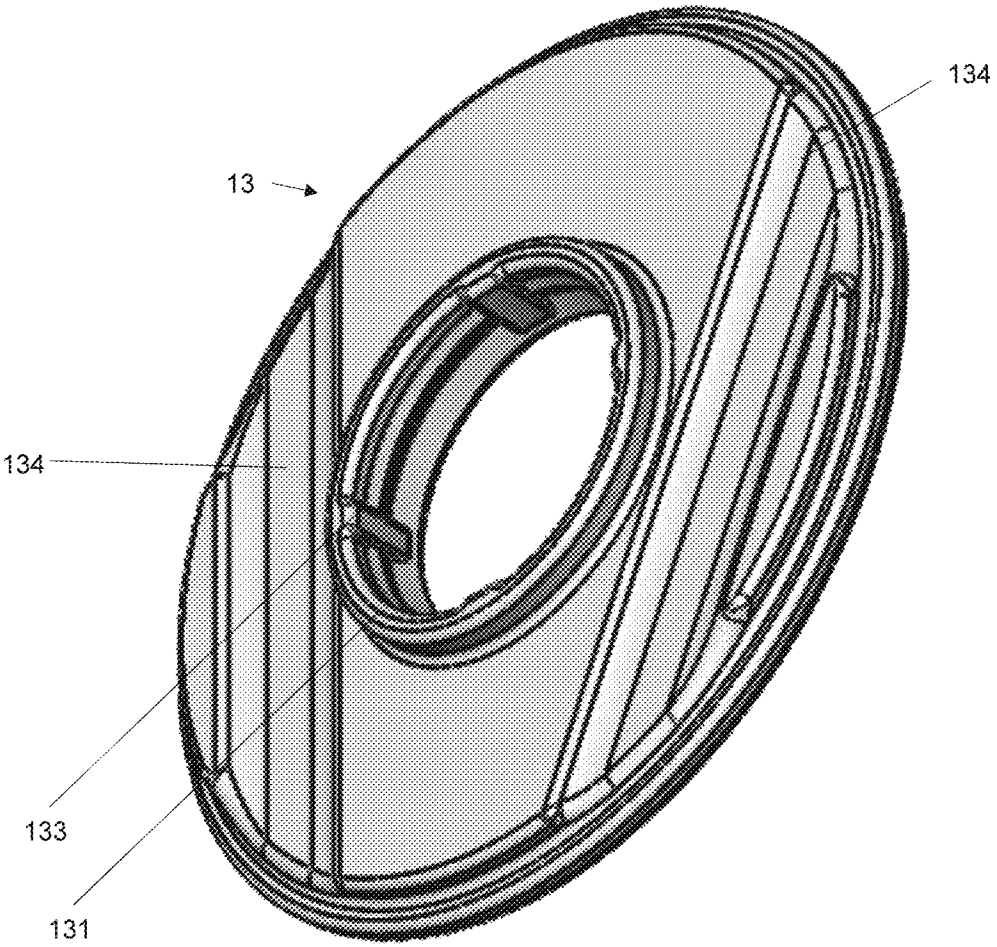
FIG. 6 is a view of an embodiment of a support disc of the disclosed technology.

The support disc 13 of the disclosed technology, shown separately at FIG. 6 and with other components of the assemblable baby bottle in FIGS. 1A, 1B and 2, comprises a cylinder 131 protruding through the support disc, and forming an aperture to receive the fitment. Protrusions 133 on the interior of the disc cylinder correspond with the spaces in the segmented locking ring 623 of the fitment, to secure the fitment to the ring in a twist-lock manner when in use. As shown in FIG. 1B, the undersurface of the threaded central ring further has a recessed lip 132 so that when positioned on a baby bottle, the lip rests on the top surface of the threaded neck, and the remainder of the disc 13 is partially received in the vacuous area of the top of the bottle, thereby seating the disc on the top of the bottle. Further, the top surface of the support disc includes a pair of depressions 134, extending at angles, to receive fingers when the support disc is used with a disposable receptacle and nipple, but independent of the assemblable bottle.

Figure 7B:
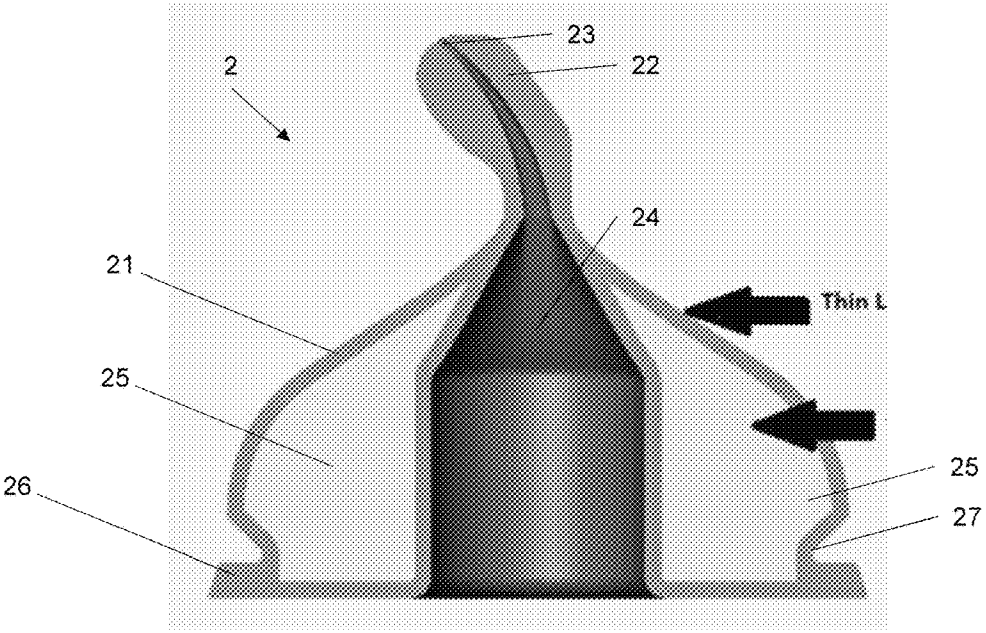
FIG. 7B is a cut-away view of another embodiment of a nipple of the disclosed technology.
Figure 7A:
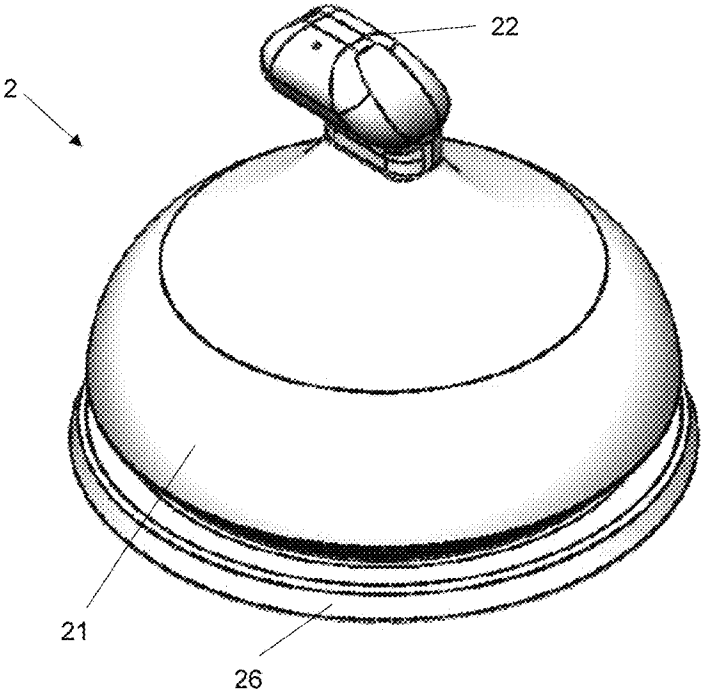
FIG. 7A is a peripheral view of an embodiment of a nipple of the disclosed technology.
Figure 9A:
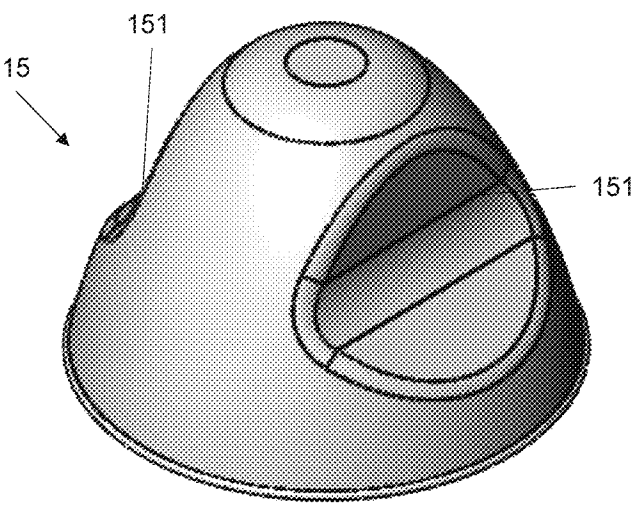
FIG. 9A is a peripheral top view of an embodiment of a cap of the disclosed technology.
Figure 9B:
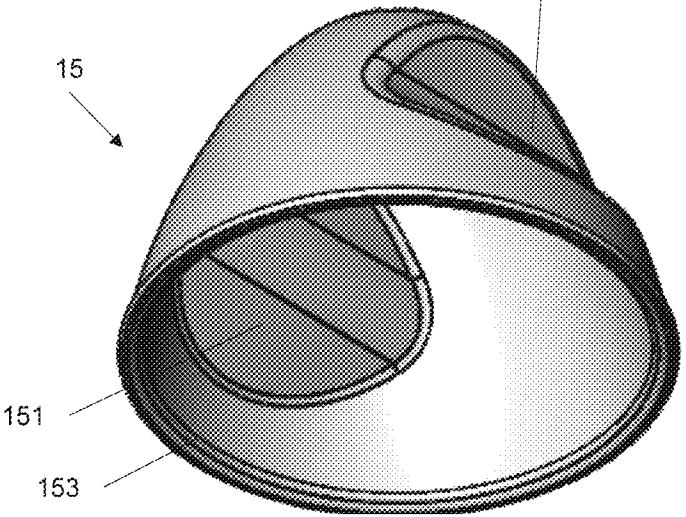
FIG. 9B is a peripheral bottom view of the cap of FIG. 9A.
Figure 8A:
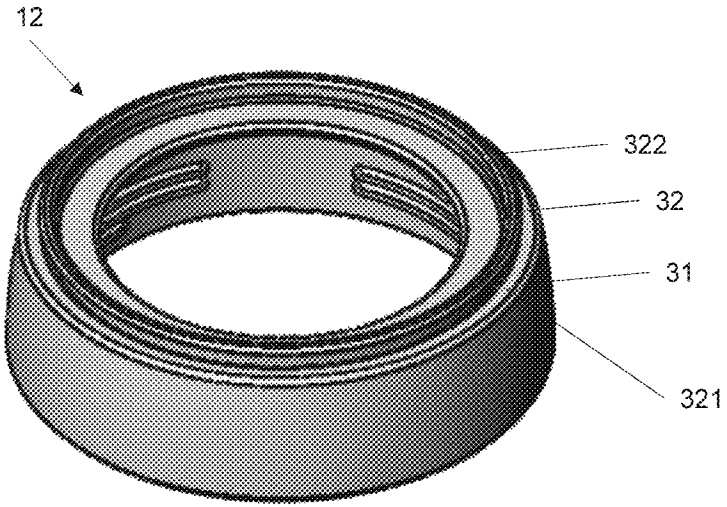
FIG. 8A is a peripheral top view of an embodiment of a securing ring of the disclosed technology.
Figure 8B:
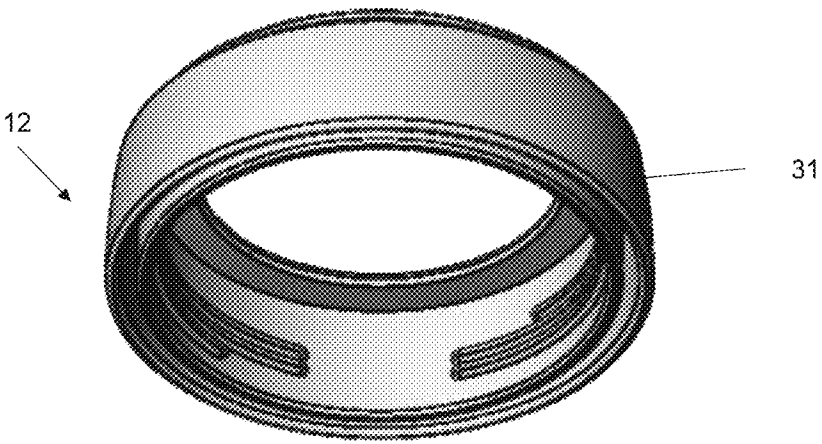
FIG. 8B is a peripheral bottom view of the securing ring of FIG. 8A.

As shown in FIGS. 1A, 1B, 7A and 7B, a nipple 2 of the disclosed technology has a body 21 and a teat 22, with a pinhole aperture 23 extending from the top of the teat and in fluid communication with an internal chamber 24 extending into the nipple body. In one embodiment, as shown in FIG. 7A, the nipple is formed from food grade silicone. In another embodiment, as shown in FIG. 7B, the exterior surfaces of the nipple body and internal chamber are formed from food grade silicone, and the space 25 between such surfaces are filled with a non-toxic, soft gel In both of these embodiments, the nipple further includes a flange 26 forming a base of the nipple and a neck 27 where the body of the nipple angularly extends upwards from the flange. When assembled as part of an assemblable baby bottle, the nipple sits on top of the support disc as shown in FIGS. 1A and 1B, and the flange is compressed by the securing ring, the internal collar of the securing ring being positioned within the nipple neck. The nipple may also be used with the support disc and disposable receptacle, apart from the bottle and remaining components of the assemblable baby bottle. In this manner of use, the internal chamber 24 of the nipple is sized to fit snuggly on the fitment, above the support disc, so that it will not come loose therefrom when an infant is suckling the nipple.

Figure 5:
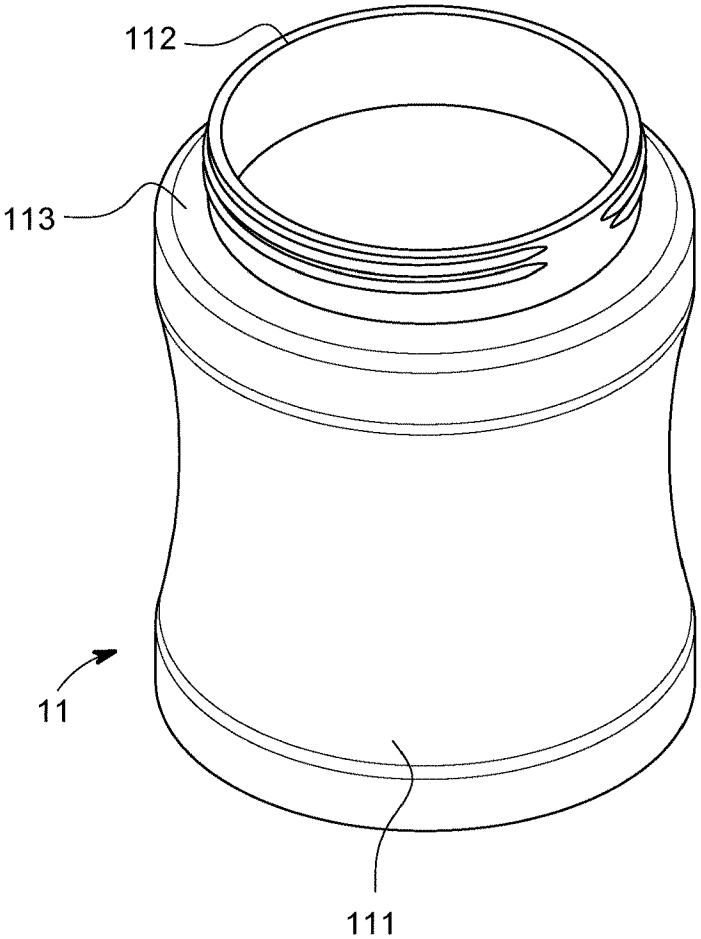
FIG. 5 is a view of an embodiment of a bottle of the disclosed technology.

Turning now to the assemblable baby bottle 1 of the disclosed technology, the same including the disposable receptacle, support disc, and nipple as hereinabove described, and further including a bottle, a securing ring and a removable cap. In the embodiment shown in FIG. 5, the bottle 11 of the assemblable baby bottle includes a cylindrical body 111 with a threaded neck 112, having a ledge 113 between the body and the neck.

The securing ring 12 of the assemblable baby bottle, an embodiment of which is shown in FIGS. 1A, 1B, 2, 8A and 8B, includes a cylindrical wall 31, with a ledge 32 extending radially inward from the cylindrical wall. The securing ring includes internal threading to engage with the threaded neck 112 of the bottle. The outside of the ledge may have a lip 321. A collar 322 with a protuberance 323 extending radially outwards is positioned on the top of the securing ring, and with the lip is designed to removably secure the cap 15 to the securing ring. The portion of the ledge 32 extending radially inward from the collar 322 receives and supports the flange 26 of the nipple, about the nipple base neck 27.

Finally, as shown in FIGS. 1, 2, 9A and 9B, the removable cap 15 includes a vacuous area sized to receive the nipple when the bottle is assembled. Two finger indentations 151 are positioned on opposing sides of the cap, for ease of securing the cap to the bottle, and removing the same. The bottom circumference of the cap is sized to be removably secured to the securing ring, wherein an internal collar 153 is positioned slightly above the bottom edge of the cap to lockingly engage with the protuberance 323 of the second ring of the securing ring, as shown in detail in FIG. 1B.

In a first embodiment, the disposable receptacle is provided, filled with powdered formula and distilled water, in separate compartments as hereinabove described. In an alternate embodiment, the disposable receptacle with a single compartment is coupled with a breast pump by means of a funnel or similar delivery means, and fresh breast milk is delivered into the disposable receptacle, a cap is secured to the fitment, and the filled receptacle is prepared for storage and later use. In yet another alternate embodiment, the disposable receptacle with a single compartment is filled with liquid formula. In the first embodiment, when ready for use pressure is applied to the liquid compartment, such as by squeezing between fingers, and the burst seal is broken, causing the powdered formula and distilled water to mix. In any of these embodiments, when ready for use, the cap is removed from the fitment, and a one-way valve is secured within the fitment (it is acknowledged that the valve may be secured within the fitment prior to securing the cap and storing the receptacle). The fitment is secured within the aperture of the support disc. At this point a nipple may be fittedly and removably secured to the fitment, above the support disc. Alternatively, the disposable receptacle and support disc may be positioned within a bottle of the disclosed technology, with a nipple positioned to receive the fitment, above the support disc, and a securing ring secured to the bottle, thereby securing the nipple and the support disc. A bottle cap may be removably secured to the securing ring, if desired.

While certain embodiments of the disclosed technology have been shown and described, it will be understood that it is not intended to limit the disclosure, but rather it is intended to cover all modifications and alternate methods falling within the spirit and the scope of the invention as defined in the appended claims.

The invention claimed is:

1. A disposable receptacle useful with an infant feeding system, the disposable receptacle comprising:

a pliable pouch having a first compartment filled with powdered formula, and a second compartment filled with distilled water, the compartments being separated by a burst seal designed to fail upon subjection to pressure of between about 1-3 lbs, a cylindrical, threaded fitment, the fitment comprising a body, with a collar on the exterior of the body and an interior collar, and a one-way valve removably positioned within the fitment, the one-way valve having a recessed ring about its exterior to receive the interior collar of the fitment, and wherein the one way valve is a duckbill valve; and wherein the size and shape of the fitment corresponds with the size and shape of an internal chamber of a nipple, to removably secure the nipple to the fitment;

wherein a top seal of the pliable pouch is secured about the body of the fitment; and wherein the nipple comprises a flange about its outer circumference to optionally secure the nipple to a baby bottle by means of a securing ring.

2. The disposable receptacle of claim 1, wherein the nipple further comprises a body and a teat, with a pinhole aperture extending from the top of the teat and in fluid communication with the internal chamber of the nipple, and wherein the nipple is formed from food grade silicone.

3. The disposable receptacle of claim 1, wherein the nipple further comprises a body and a teat, with a pinhole aperture extending from the top of the teat and in fluid communication with the internal chamber of the nipple, and wherein an exterior surface of the nipple body and a surface of the internal chamber are formed from food grade silicone, and the space between the exterior surface of the nipple body and the surface of the internal chamber are filled with a non-toxic, soft gel.

4. The disposable receptacle of claim 1, wherein the flange forms a base of the nipple and a neck, and wherein a body of the nipple angularly extends upwards from the flange.

5. An infant feeding system comprising:

a pliable pouch having a first compartment filled with powdered formula, and a second compartment filled with distilled water, the compartments being separated by a burst seal designed to fail upon subjection to pressure of between about 1-3 lbs, a cylindrical, threaded fitment, the fitment comprising a body, with a collar on the exterior of the body, and a one-way valve removably positioned within the fitment, wherein the one-way valve is a duckbill valve, and wherein a top seal of the pliable pouch is secured about the body of the fitment; and a nipple having an integral internal chamber of silicon sized and configured to tightly and removably receive a portion of the fitment.

6. The infant feeding system of claim 5, further comprising:

a bottle having a threaded neck, and a securing ring configured to be removably secured about a neck of the bottle.

7. The infant feeding system of claim 5, wherein the nipple further comprises a body and a teat, with a pinhole aperture extending from the top of the teat and in fluid communication with the internal chamber of the nipple, and wherein the nipple is formed from food grade silicone.

8. The infant feeding system of claim 5, wherein the nipple further comprises a body and a teat, with a pinhole aperture extending from the top of the teat and in fluid communication with the internal chamber of the nipple, and wherein an exterior surface of the nipple body and a surface of the internal chamber are formed from food grade silicone, and the space between the exterior surface of the nipple body and the surface of the internal chamber are filled with a non-toxic, soft gel.

9. The infant feeding system of claim 5, wherein the nipple comprises a flange forming a base of the nipple and a neck, where the body of the nipple angularly extends upwards from the flange.

10. An infant feeding system comprising:

a cylindrical fitment and a one-way valve removably positioned within the fitment, the one-way valve having a recessed ring about its exterior to receive an interior collar of the fitment and thereby removably secure the one way valve within the fitment, wherein the one-way valve is a duck-bill valve, the fitment further comprising a threaded exterior surface to receive a removable cap having a corresponding threaded interior surface;

the cylindrical fitment being positioned within and secured by a top seal of a pliable pouch, the pliable pouch having a first compartment filled with powdered formula, and a second compartment filled with distilled water, the compartments being separated by a burst seal designed to fail upon subjection to pressure of between about 1-3 lbs.; and a unitary nipple with an exterior surface of silicone, the nipple having an internal chamber of silicone sized and shaped to receive, be directly in contact with and be removably secured to the fitment by means of the threaded exterior surface of the fitment, and further having a flange to optionally secure the nipple to a baby bottle by means of a securing ring.

* * * * *